US012043363B2

(12) United States Patent
Rautaheimo et al.

(10) Patent No.: US 12,043,363 B2
(45) Date of Patent: Jul. 23, 2024

(54) GRID FOR A TUNNEL THRUSTER

(71) Applicant: Elomatic Oy, Turku (FI)

(72) Inventors: Patrik Rautaheimo, Turku (FI); Juha Tanttari, Littoinen (FI)

(73) Assignee: ELOMATIC OY, Turku (FI)

( * ) Notice: Subject to any disclaimer, the term of this patent is extended or adjusted under 35 U.S.C. 154(b) by 454 days.

(21) Appl. No.: 17/414,713

(22) PCT Filed: Dec. 17, 2019

(86) PCT No.: PCT/FI2019/050899
§ 371 (c)(1),
(2) Date: Jun. 16, 2021

(87) PCT Pub. No.: WO2020/128159
PCT Pub. Date: Jun. 25, 2020

(65) Prior Publication Data

US 2022/0063784 A1 Mar. 3, 2022

(30) Foreign Application Priority Data

Dec. 17, 2018 (EP) ..... 18213026

(51) Int. Cl.
*B63H 5/16* (2006.01)
*B63H 1/04* (2006.01)

(52) U.S. Cl.
CPC ..... *B63H 5/165* (2013.01); *B63H 1/04* (2013.01)

(58) Field of Classification Search
CPC ..... B63H 1/04; B63H 5/165
See application file for complete search history.

(56) References Cited

U.S. PATENT DOCUMENTS 5,111,763 A * 5/1992 Moerbe ..... B63H 5/16 440/70
5,697,022 A * 12/1997 Matsuda ..... G03G 21/1832 399/113
6,327,994 B1 * 12/2001 Labrador ..... B63B 39/06 114/382
8,435,089 B2 * 5/2013 Gaudin ..... B63H 5/14 440/67
2003/0228171 A1 * 12/2003 Miyabe ..... G03G 21/1814 399/284

(Continued)

FOREIGN PATENT DOCUMENTS

CN 1497373 A 5/2004
CN 1503070 A 6/2004

(Continued)

OTHER PUBLICATIONS

Japanese Office Action received for Japanese Application No. 2021-533495 dated May 30, 2023, 13 pgs.

(Continued)

*Primary Examiner* — S. Joseph Morano
*Assistant Examiner* — Jovon E Hayes
(74) *Attorney, Agent, or Firm* — Merchant & Gould P.C.

(57) ABSTRACT

A grid (100) is for a tunnel thruster (200). The grid (100) includes a plurality of first radially extending bars (101) arranged at angular intervals from each other, and a plurality of first connecting bars (102). Each of the first connecting bars (102) are connected between adjacent first radially extending bars (101).

18 Claims, 4 Drawing Sheets

(56) References Cited

U.S. PATENT DOCUMENTS

| | | | | |
|---|---|---|---|---|
| 2010/0139130 | A1* | 6/2010 | Wagenaar | B63G 8/001 37/342 |
| 2016/0077485 | A1 | 3/2016 | Sproul | |
| 2016/0340009 | A1* | 11/2016 | Stevens | B63H 5/165 |
| 2017/0350419 | A1* | 12/2017 | Ichigaya | F04D 29/601 |
| 2019/0040873 | A1* | 2/2019 | Tadokoro | F04D 29/663 |
| 2021/0269132 | A1* | 9/2021 | Leine | A01K 79/00 |

FOREIGN PATENT DOCUMENTS

| | | | |
|---|---|---|---|
| CN | 101046658 | A | 10/2007 |
| CN | 101477324 | A | 7/2009 |
| CN | 201583792 | U | 9/2010 |
| CN | 203490467 | U | 3/2014 |
| CN | 203705825 | U | 7/2014 |
| CN | 104428720 | A | 3/2015 |
| CN | 106275339 | A | 1/2017 |
| DE | 102015221427 | A1 | 5/2017 |
| EP | 0035600 | A1 | 9/1981 |
| JP | 1978009698 | U | 1/1978 |
| JP | S539698 | U | 1/1978 |
| JP | 1984027998 | U | 2/1984 |
| JP | S5927998 | U | 2/1984 |
| JP | 1994035099 | U | 5/1994 |
| JP | H0635099 | U | 5/1994 |
| JP | H0683588 | U | 11/1994 |
| JP | H08188297 | A | 7/1996 |
| JP | 2008197588 | A | 8/2008 |
| KR | 2012-0015572 | A | 2/2012 |
| KR | 20120006581 | U | 9/2012 |
| KR | 2014-0036409 | A | 3/2014 |

OTHER PUBLICATIONS

"Veth Steering Grid—Veth Propulsion—Thruster Supplier", Feb. 1, 2018, Internet <URL:https://web.archive.org/web/20180201074216/https://www.vethpropulsion.com/products/bow-thrusters/steering-grid/>, searched on May 24, 2023, 5 pgs.

Tallers blanchadell Helices transversales e implsores azimutales retractiles Jul. 6, 2017, Internet, <URL:https://web.archive.org/web/20170706110449/http://www.blanchadell.com/mecanica/helices-transversales-e-impulsores-retractiles/>, searched on May 24, 2023, 5 pgs.

Chinese Office Action received for CN Serial No. 2019800835685, 19 pgs.

Chinese Office Action for Chinese Patent Application No. 201780085204.1 dated Apr. 22, 2021 (English translation, 14 pages).

European Search Report for European Patent Application No. 18213026 dated May 17, 2019, 3 pages.

International Search Report and Written Opinion of the International Searching Authority issued in corresponding International Patent Application No. PCT/FI2019/050899, dated Feb. 26, 2020, 14 pages.

Author Unknown, "Tips on Thruster Installation—Thrustmaster", May 16, 2015, retrieved Feb. 17, 2020, 5 pages.

Author Unknown, "Veth Steering Grid—Veth Propulsion—Thruster Supplier", Feb. 1, 2018, retrieved May 17, 2019, 3 pages.

Prunonosa: "Tallers Blanchadell > Helices transversales e impulsores azimutales retractiles", Jul. 6, 2017, retrieved May 17, 2019 (with Machine Translation, 8 pages).

Summons to Attend Oral Proceedings received for EP Application No. 19827771.7 on Apr. 23, 2024, 6 pgs.

Anonymous: The Performance of a Tunnel Bow Thruster with Slow Speed Ahead: A revisited Issue, The Journal of Navigation, Cambridge Core, Oct. 7, 2009, XP093148224, retrieved from the internet: URL:https://www.cambridge.org/core/journals/journal-of-navigation/articel/performance-of-a-tunnel-bow-thruster-with-slow-speed-ahead-a-revisited-issue, 22 pgs.

* cited by examiner

GRID FOR A TUNNEL THRUSTER

TECHNICAL FIELD OF THE INVENTION

This application is a National Stage Application of PCT/FI2019/050899, filed 17 Dec. 2019, which claims benefit of Ser. No. 18/213,026.0, filed 17 Dec. 2018 in Europe and which applications are incorporated herein by reference. To the extent appropriate, a claim of priority is made to each of the above-disclosed applications.

The present invention relates to a grid for a tunnel thruster according to the preamble of the appended independent claim. The invention also relates to a tunnel thruster and a vessel incorporating such a grid.

BACKGROUND OF THE INVENTION

Tunnel thrusters, also known as transverse or manoeuvring thrusters, are widely used in vessels, such as ships and boats. A tunnel thruster that is typically installed in the bow or stern of a vessel, below the waterline, provides a transverse thrust to support manoeuvring, mooring, station keeping and dynamic positioning of the vessel.

An exemplary tunnel thruster comprises a tunnel section that is open at both ends. A propeller is mounted inside the tunnel section and it can be rotated by a motor to create a thrust in either direction.

A known problem associated with the tunnel thruster is the vessel's increased resistance to motion in water. A known solution to this problem is to provide the ends (openings) of the tunnel section with grids that comprise bars arranged perpendicularly to the movement direction of the vessel. Even though these grids decrease the vessel's resistance to motion in water, they also create a problem in the form of the decreased thrust of the tunnel thruster. The thrust is decreased because of the turbulent resistance produced by the bars of the grid.

OBJECTIVES OF THE INVENTION

It is the main objective of the present invention to reduce or even eliminate the prior art problems presented above.

It is an objective of the present invention to provide a grid for a tunnel thruster. In more detail, it is an objective of the invention to provide a grid for a tunnel thruster that enables to decrease the resistance to motion in water and increase the thrust of the tunnel thruster. It is also an objective of the invention to provide a grid that is reliable and durable. It is a further objective of the invention to provide a grid that produces low noise and vibration. It is yet a further objective of the invention to provide a grid that is easy to install to a tunnel section of a tunnel thruster.

It is also an objective of the present invention to provide a tunnel thruster that produces a small resistance to motion in water and a large thrust. It is a further objective of the invention to provide a vessel having a small resistance to motion in water and a large thrust.

In order to realise the above-mentioned objectives, the grid according to the invention is characterised by what is presented in the characterising portion of the appended independent claim. Advantageous embodiments of the invention are described in the dependent claims.

DESCRIPTION OF THE INVENTION

A grid according to the invention for a tunnel thruster comprises a plurality of first radially extending bars arranged at angular intervals from each other, and a plurality of first connecting bars, each of the first connecting bars being connected between adjacent first radially extending bars.

The grid according to the invention is intended to be used in a tunnel thruster, which can be installed in a hull of a vessel, such as a ship or a boat, to provide a transverse thrust. The tunnel thruster is preferably installed in the bow or stern of the vessel. The tunnel thruster comprises a tunnel section and a propeller that is arranged inside the tunnel section to create the thrust in either direction. The grid is preferably arranged inside the tunnel section and close to an end (opening) of the tunnel section. The grid is preferably dimensioned in such a manner that the first radially extending bars can be connected to the wall of the tunnel section.

The size and shape of the grid can vary depending on the application. The grid can be substantially circular and dimensioned to fit inside the tunnel section having an essentially round cross-section. The grid can be substantially flat or planar, although in some embodiments it can be slightly curved.

The first radially extending bars of the grid are arranged at angular intervals from each other. The angles between the adjacent first radially extending bars can be the same with or different from each other. It is also possible to arrange the first radially extending bars in such a manner that the angles between the adjacent first radially extending bars have, for example, two, three, four or five possible values.

A purpose of the first radially extending bars is to convert the rotational flow generated by a propeller of a tunnel thruster into axial (linear) flow. This improves the thrust of the tunnel thruster.

The first radially extending bars are preferably substantially straight, although in some embodiments the first radially extending bars may be curved in one or more directions. The first radially extending bars can also be twisted along their lengths. The length of the first radially extending bars can be, for example, 0.1-5 m, preferably 0.5-4 m or more preferably 0.5-2.5 m. Preferably, the first radially extending bars have substantially the same length. The first radially extending bars are preferably made of stainless steel.

The number of the first radially extending bars can vary depending on the application. The number of the first radially extending bars can be, for example, 4-12, or preferably 5, 7, 9 or 11. Preferably, the number of the first radially extending bars differs from the number of propeller blades in such a manner that these numbers are non-divisible.

The first connecting bars of the grid are connected between the adjacent first radially extending bars. Each first connecting bar is connected between two adjacent first radially extending bars so that one end of the first connecting bar is connected to one first radially extending bar and the other end of the first connecting bar is connected to another first radially extending bar. The first connecting bars can be connected to the first radially extending bars, for example, by welding or by using connecting means such as bolts. Preferably, each of the first radially extending bars is connected to the adjacent first radially extending bars with the first connecting bar. In this case, the number of the first connecting bars is the same as the number of the first radially extending bars.

A purpose of the first connecting bars is to decrease the resistance to motion in water. They also improve the rigidity of the grid.

The first connecting bars can be substantially straight or curved in one or more directions. The first connecting bars can be curved and arranged to the grid in such a manner that they together form a circle. The length of the first connecting bars can be, for example, 0.1-2 m, preferably 0.5-1.5 m or more preferably 0.5-1 m. Preferably, the first connecting bars have substantially the same length. The first connecting bars are preferably made of stainless steel.

The number of the first connecting bars can vary depending on the application. The number of the first connecting bars can be, for example, 4-12, or preferably 5, 7, 9 or 11. Preferably, the number of the first connecting bars is the same as the number of the first radially extending bars.

An advantage of the grid according to the invention is that it decreases the resistance to motion in water and increases the thrust of the tunnel thruster. Another advantage of the grid according to the invention is that it is reliable and durable. Yet another advantage of the grid according to the invention is that it produces low noise and vibration. Yet another advantage of the grid according to the invention is that it is easy to install to a tunnel section of a tunnel thruster. Yet another advantage of the grid according to the invention is that it prevents objects from entering a tunnel section of a tunnel thruster and thus protects a propeller inside the tunnel section.

According to an embodiment of the invention the first radially extending bars are flat bars, each of the flat bars having a leading edge that is rounded or chamfered. The whole or part of the length of the leading edge can be rounded or chamfered. The flat bars are arranged in the grid so that their planes are perpendicular to the plane of the grid. The grid is meant to be arranged in connection with an end of a tunnel section of a tunnel thruster so that the leading edges of the flat bars are facing a propeller that is arranged inside the tunnel section. Trailing edges of the flat bars can also be rounded or chamfered. The leading and trailing edges are longitudinal edges of the flat bar. The length of the flat bars can be, for example, 0.1-5 m, preferably 0.5-4 m or more preferably 0.5-2.5 m. The width of the flat bars can be, for example, 5-50 cm or preferably 10-30 cm. The thickness of the flat bars can be, for example, 0.1-5 cm or preferably 1-2 cm. An advantage of the rounded or chamfered leading edge is that it improves the thrust of a tunnel thruster. Another advantage of the rounded or chamfered leading edge is that it decreases noise and vibration.

According to an embodiment of the invention the first radially extending bars are flat bars, each of the flat bars being bent in the transverse direction of the flat bar.

Preferably, the flat bar is bent so that at least the leading edge of the flat bar is bent. The bending radius can be, for example, 1-10 cm. An advantage of the bending is that it improves the thrust of a tunnel thruster. Another advantage of the bending is that it decreases noise and vibration.

According to an embodiment of the invention each of the first radially extending bars is connected to the adjacent first radially extending bars with the first connecting bar. In this case, the number of the first connecting bars in the grid is the same as the number of the first radially extending bars. An advantage of connecting each first radially extending bar with the first connecting bars to the adjacent first radially extending bars is that it decreases the resistance to motion in water and it also makes the grid more rigid.

According to an embodiment of the invention the first connecting bars are connected in such a manner that they are at the same distance from the centre of the grid. By the centre of the grid is meant a point at which first ends of the first radially extending bars are attached together or at which extension lines of the first radially extending bars intersect. The distance of the first connecting bars from the centre of the grid can be, for example, 0.1-2 m, preferably 0.5-1.5 m or more preferably 0.5-1 m. The first connecting bars can be curved in such a manner that they together form a circle. An advantage of arranging the first connecting bars at the same distance from the centre of the grid is that it decreases the resistance to motion in water and it also makes the grid more rigid.

According to an embodiment of the invention first ends of the first radially extending bars are connected together. The first ends of the first radially extending bars are connected together at the centre of the grid. An advantage of connecting the first ends of the first radially extending bars together is that it reduces the pressure drop over the grid.

According to an embodiment of the invention the grid comprises a centre part to which first ends of the first radially extending bars are connected. The centre part can be, for example, a disc or a ring. Preferably, the diameter of the centre part is smaller than the diameter of a propeller hub. An advantage of the centre part is that it facilitates optimizing the minimum area covering the opening of the tunnel section. It also makes the grid easy to manufacture.

According to an embodiment of the invention the grid comprises a plurality of second connecting bars, each of the second connecting bars being connected between adjacent first radially extending bars in such a manner that the second connecting bars are farther away from the centre of the grid than the first connecting bars.

The second connecting bars of the grid are connected between the adjacent first radially extending bars. Each second connecting bar is connected between two adjacent first radially extending bars so that one end of the second connecting bar is connected to one first radially extending bar and the other end of the second connecting bar is connected to another first radially extending bar. The second connecting bars can be connected to the first radially extending bars, for example, by welding or by using connecting means such as bolts. Preferably, each of the first radially extending bars is connected to the adjacent first radially extending bars with the second connecting bar. In this case, the number of the second connecting bars is the same as the number of the first radially extending bars.

The second connecting bars can be substantially straight or curved in one or more directions. The second connecting bars can be curved and arranged to the grid in such a manner that they together form a circle. The length of the second connecting bars can be, for example, 0.3-3 m, preferably 0.6-1.7 m or more preferably 0.7-1.2 m. Preferably, the second connecting bars have substantially the same length. The second connecting bars are preferably made of stainless steel.

The number of the second connecting bars can vary depending on the application. The number of the second connecting bars can be, for example, 4-12, or preferably 5, 7, 9 or 11. Preferably, the number of the second connecting bars is the same as the number of the first radially extending bars.

An advantage of the second connecting bars is that they further decrease the resistance to motion in water and they also make the grid more rigid.

According to an embodiment of the invention the second connecting bars are connected in such a manner that they are at the same distance from the centre of the grid. The distance of the second connecting bars from the centre of the grid can be, for example, 0.3-3 m, preferably 0.6-1.7 m or more preferably 0.7-1.2 m. The second connecting bars can be curved in such a manner that they together form a circle. An advantage of connecting the second connecting bars at the same distance from the centre of the grid is that it decreases the resistance to motion in water and it also makes the grid more rigid.

According to an embodiment of the invention the grid comprises a plurality of second radially extending bars arranged at angular intervals from each other, each of the second radially extending bars being connected between one first connecting bar and one second connecting bar. Each second radially extending bar is connected so that one end of the second radially extending bar is connected to the first connecting bar and the other end of the second radially extending bar is connected to the second connecting bar. The second radially extending bars can be connected to the first and second connecting bars, for example, by welding or by using connecting means such as bolts. The second radially extending bars are arranged radially between the first radially extending bars. Preferably, the second radially extending bars are arranged in such a manner that their extension lines intersect at the centre of the grid. The second radially extending bars can be dimensioned in such a manner that their ends may be connected to a wall of a tunnel section of a tunnel thruster.

The angles between the adjacent second radially extending bars can be the same with or different from each other. It is also possible to arrange the second radially extending bars in such a manner that the angles between the adjacent second radially extending bars have, for example, two, three, four or five possible values.

The second radially extending bars are preferably substantially straight, although in some embodiments the second radially extending bars may be curved in one or more directions. The second radially extending bars can also be twisted along their lengths. The length of the second radially extending bars can be, for example, 0.1-3 m, preferably 0.5-2 m or more preferably 0.5-1.2 m. Preferably, the second radially extending bars have substantially the same length. The second radially extending bars are preferably made of stainless steel.

The number of the second radially extending bars can vary depending on the application. The number of the second radially extending bars can be, for example, 4-12, or preferably 5, 7, 9 or 11. Preferably, the number of the second radially extending bars is the same as the number of the first radially extending bars.

An advantage of the second radially extending bars is that they improve the thrust of the tunnel thruster by converting the rotational flow generated by a propeller of a tunnel thruster into axial (linear) flow.

According to an embodiment of the invention the second radially extending bars are flat bars, each of the flat bars having a leading edge that is rounded or chamfered. The whole or part of the length of the leading edge can be rounded or chamfered. The flat bars are arranged in the grid so that their planes are perpendicular to the plane of the grid. The grid is meant to be arranged in connection with an end of a tunnel section of a tunnel thruster so that the leading edges of the flat bars are facing a propeller that is arranged inside the tunnel section. Trailing edges of the flat bars can also be rounded or chamfered. The leading and trailing edges are longitudinal edges of the flat bar. The length of the flat bars can be, for example, 0.1-3 m, preferably 0.5-2 m or more preferably 0.5-1.2 m. The width of the flat bars can be, for example, 5-50 cm or preferably 10-30 cm. The thickness of the flat bars can be, for example, 0.1-5 cm or preferably 1-2 cm. An advantage of the rounded or chamfered leading edge is that it improves the thrust of a tunnel thruster. Another advantage of the rounded or chamfered leading edge is that it decreases noise and vibration.

According to an embodiment of the invention the second radially extending bars are flat bars, each of the flat bars being bent in the transverse direction of the flat bar. Preferably, the flat bar is bent so that at least the leading edge of the flat bar is bent. The bending radius can be, for example, 1-10 cm. An advantage of the bending is that it improves the thrust of a tunnel thruster. Another advantage of the bending is that it decreases noise and vibration.

According to an embodiment of the invention the first and/or second radially extending bars and the first and/or second connecting bars are flat bars. The width of the radially extending bars and/or the connecting bars can be, for example, 5-50 cm or preferably 10-30 cm. The thickness of the radially extending bars and/or the connecting bars can be, for example, 0.1-5 cm or preferably 1-2 cm.

According to an embodiment of the invention the number of the first radially extending bars and/or the second radially extending bars is 4-12. Preferably, the number of the first radially extending bars and/or the second radially extending bars is 5, 7, 9 or 11.

The present invention also relates to a tunnel thruster. The tunnel thruster according to the invention comprises a tunnel section, a propeller arranged inside the tunnel section, and a grid according to the invention arranged in connection with an end of the tunnel section.

The tunnel section is tubular, and it is open at both ends. The length of the tunnel section can be, for example, 1-4 m, 4-10 m, or 10-20 m. Preferably, the tunnel section has a round cross-section. The diameter of the tunnel section can be, for example, 1-4 m.

The propeller can be a Controllable Pitch (CP) or Fixed Pitch (FP) propeller. The propeller can be driven by a motor that is built on the tunnel section. Alternatively, the propeller can be driven by a separately mounted motor that is located outside the tunnel section. With the motor, the propeller can be rotated to create the thrust in either direction.

The grid is preferably arranged inside the tunnel section and close to the end (opening) of the tunnel section. The grid is preferably dimensioned in such a manner that the first radially extending bars can be connected to the wall of the tunnel section. Preferably, both ends (openings) of the tunnel section are provided with a grid according to the invention.

The tunnel thruster according to the invention can be installed in a hull of a vessel, such as a ship or a boat, to provide a transverse thrust. The tunnel thruster is preferably installed below the waterline in the bow or stern of the vessel. The tunnel thruster can be used in manoeuvring, mooring, station keeping and dynamic positioning of the vessel.

An advantage of the tunnel thruster according to the invention is that it produces a small resistance to motion in water and a large thrust.

According to an embodiment of the invention the grid is arranged inside the tunnel section at a distance of at least 10 mm from the end of the tunnel section. It has been found that by positioning the grid at the distance of at least 10 mm from the end (opening) of the tunnel section, the resistance to motion in water is considerably reduced.

According to an embodiment of the invention the first radially extending bars are connected to the tunnel section. The first radially extending bars can be connected to the wall of the tunnel section, for example, by welding or by using connecting means such as bolts.

According to an embodiment of the invention the number of the first radially extending bars and/or the second radially extending bars differs from the number of propeller blades. Preferably, the number of the first radially extending bars and/or the second radially extending bars differs from the number of propeller blades in such a manner that these numbers are non-divisible. An advantage of this is that it reduces the mechanical resonance provided by the propeller and the grid.

The present invention also relates to a vessel. The vessel according to the invention comprises a tunnel thruster according to the invention installed in a hull of the vessel. The tunnel thruster is preferably installed below the waterline in the bow or stern of the vessel. The tunnel thruster provides a transverse thrust to support manoeuvring, mooring, station keeping and dynamic positioning of the vessel. The vessel can be a ship or a boat. The vessel may comprise more than one tunnel thruster, for example, 2, 3 or 4 tunnel thrusters. The vessel may comprise 1-4 tunnel thrusters installed in the bow and/or the stern of the vessel.

An advantage of the vessel according to the invention is that it has a small resistance to motion in water and a large thrust.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

The exemplary embodiments presented in this text and their advantages relate by applicable parts to the grid, the tunnel thruster as well as the vessel according to the invention, even though this is not always separately mentioned.

DETAILED DESCRIPTION OF THE DRAWINGS

The same reference signs are used of the same or like components in different embodiments.

Figure 1:
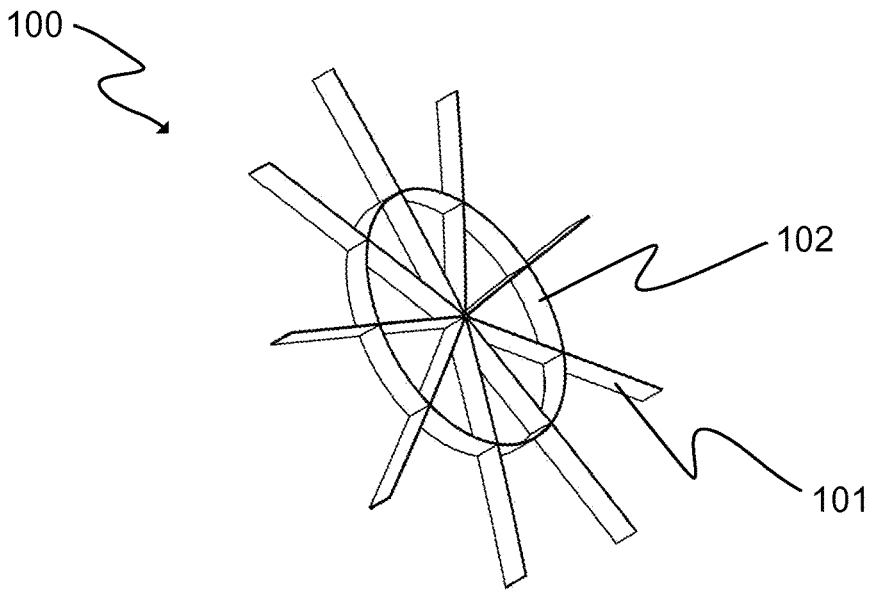
FIG. 1 illustrates a grid according to a first embodiment of the invention.

FIG. 1 illustrates a grid according to a first embodiment of the invention. The grid 100 comprises first radially extending bars 101, which are arranged at angular intervals from each other. The first ends of the first radially extending bars 101 are connected together at the centre of the grid 100. The second ends of the first radially extending bars 101 can be connected to a tunnel section of a tunnel thruster (not shown in FIG. 1). The first radially extending bars 101 are straight and have the same length.

The grid 100 also comprises first connecting bars 102. Each first connecting bar 102 is connected between two adjacent first radially extending bars 101 so that one end of the first connecting bar 102 is connected to one first radially extending bar 101 and the other end of the first connecting bar 102 is connected to another first radially extending bar 101. The first connecting bars 102 are connected at the same distance from the centre of the grid 100 and they are curved in such a manner that they together form a circle.

Figure 2:
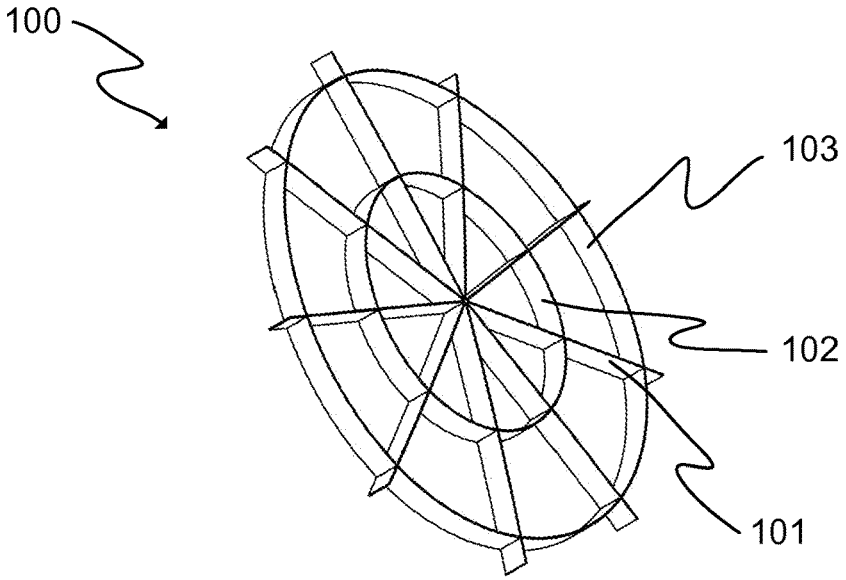
FIG. 2 illustrates a grid according to a second embodiment of the invention.

FIG. 2 illustrates a grid according to a second embodiment of the invention. The grid of FIG. 2 differs from the grid of FIG. 1 in that the grid 100 further comprises second connecting bars 103. Each second connecting bar 103 is connected between two adjacent first radially extending bars 101 so that one end of the second connecting bar 103 is connected to one first radially extending bar 101 and the other end of the second connecting bar 103 is connected to another first radially extending bar 101. The second connecting bars 103 are connected farther away from the centre of the grid 100 than the first connecting bars 102. The second connecting bars 103 are connected at the same distance from the centre of the grid 100 and they are curved in such a manner that they together form a circle.

Figure 3:
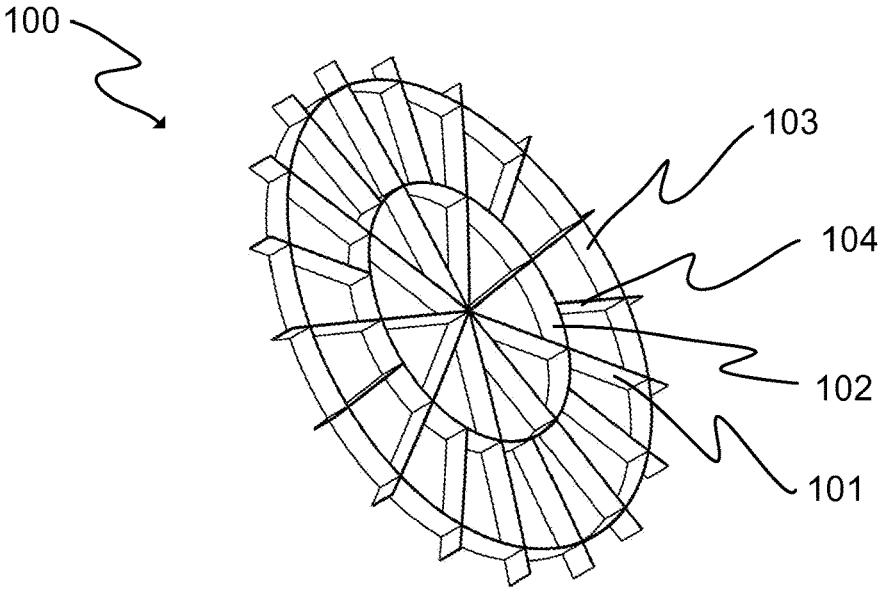
FIG. 3 illustrates a grid according to a third embodiment of the invention.

FIG. 3 illustrates a grid according to a third embodiment of the invention. The grid of FIG. 3 differs from the grid of FIG. 2 in that the grid 100 further comprises second radially extending bars 104, which are arranged at angular intervals from each other. Each second radially extending bar 104 is connected to one first connecting bar 102 and one second connecting bar 103. The second radially extending bars 104 are arranged radially between the first radially extending bars 101 in such a manner that their extension lines intersect at the centre of the grid 100. The second radially extending bars 104 are straight and have the same length.

Figure 4:
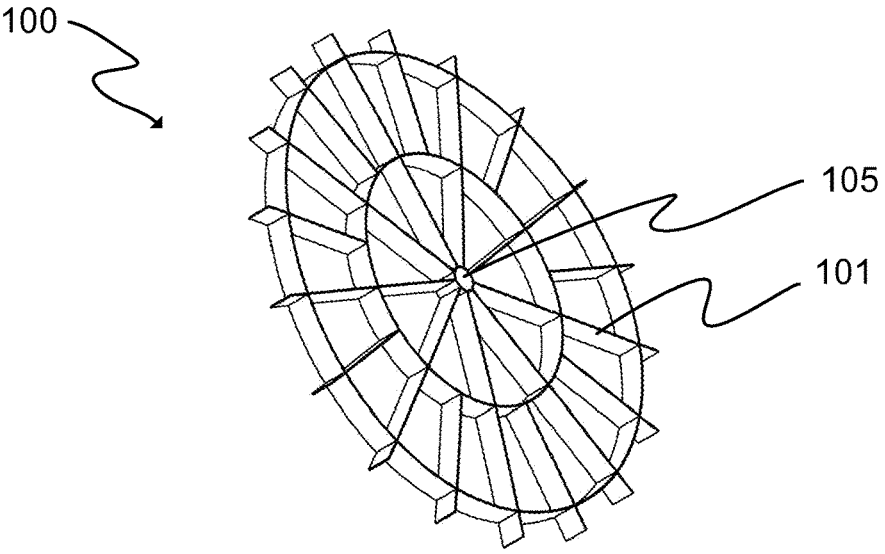
FIG. 4 illustrates a grid according to a fourth embodiment of the invention.

FIG. 4 illustrates a grid according to a fourth embodiment of the invention. The grid of FIG. 4 differs from the grid of FIG. 3 in that the grid 100 comprises a centre part 105 to which the first ends of the first radially extending bars 101 are connected. In FIG. 4, the centre part 105 is a disc.

Figure 5:
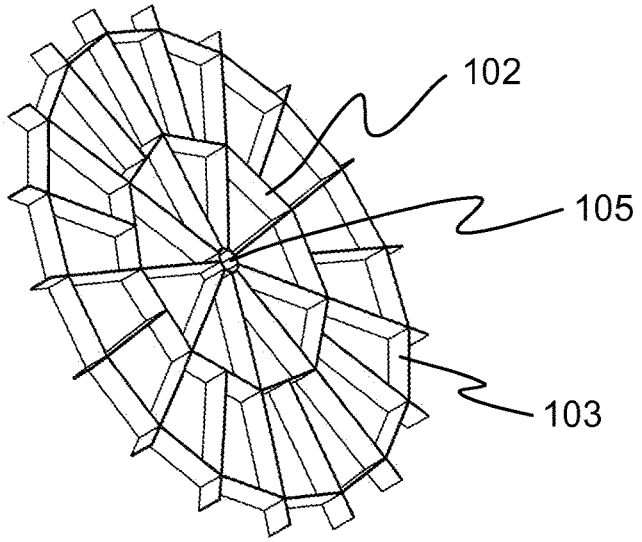
FIG. 5 illustrates a grid according to a fifth embodiment of the invention.

FIG. 5 illustrates a grid according to a fifth embodiment of the invention. The grid of FIG. 5 differs from the grid of FIG. 4 in that the centre part 105 is a ring and that the first connecting bars 102 and the second connecting bars 103 are straight.

Figure 6:
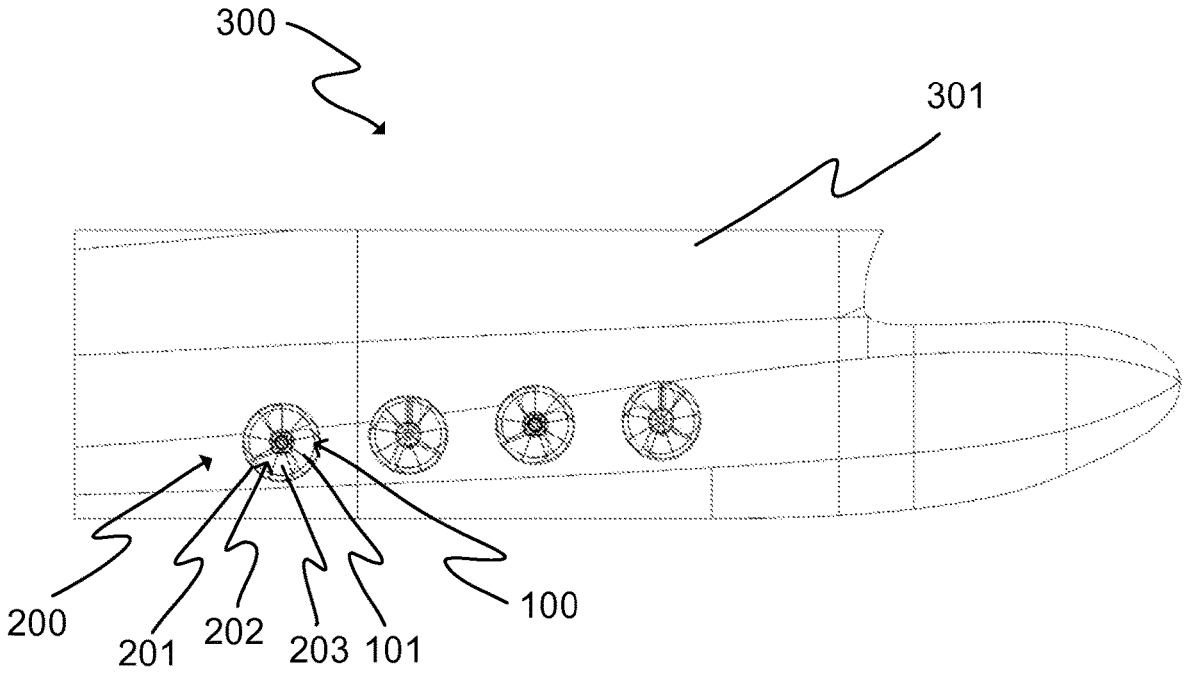
FIG. 6 illustrates tunnel thrusters according to an embodiment of the invention.

FIG. 6 illustrates tunnel thrusters according to an embodiment of the invention. The tunnel thrusters 200 are installed in a hull 301 of a vessel 300 to provide a transverse thrust. The tunnel thruster 200 comprises a tunnel section 201 that is tubular and open at both ends. The tunnel section 201 has a round cross-section. The tunnel thruster 200 comprises a propeller 202 that is arranged inside the tunnel section 201. The propeller 202 is driven by a motor (not shown in FIG. 6) that is located outside the tunnel section 201. With the motor, the propeller 202 can be rotated to create the thrust in either direction.

The tunnel thruster 200 comprises a grid 100 that is arranged inside and close to an end of the tunnel section 201. The ends of the first radially extending bars 101 are connected to the wall of the tunnel section 201. The number of the first radially extending bars 101 differs from the number of propeller blades 203 in such a manner that these numbers are non-divisible.

Figure 7A:
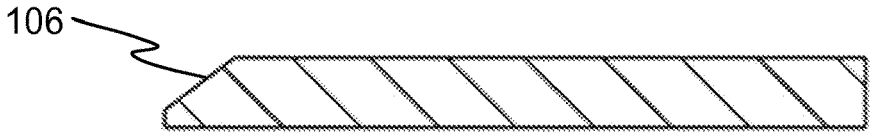
FIGS. 7A-7E illustrate exemplary profiles of the first and second radially extending bars.
Figure 7B:
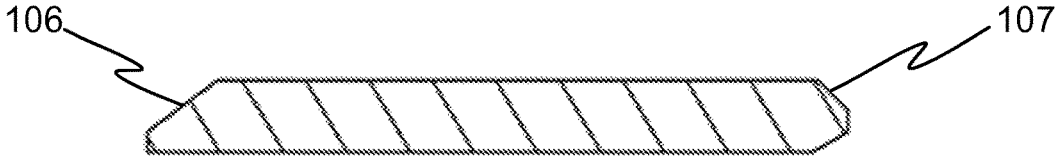
Figure 7C:
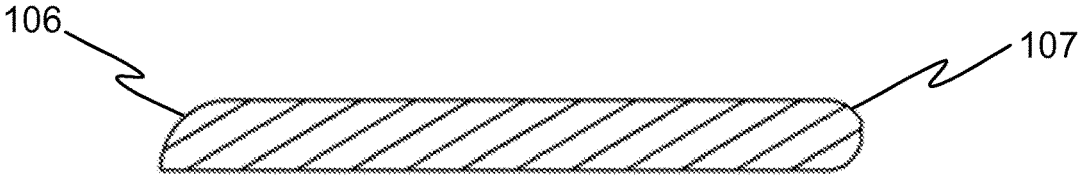
Figure 7D:
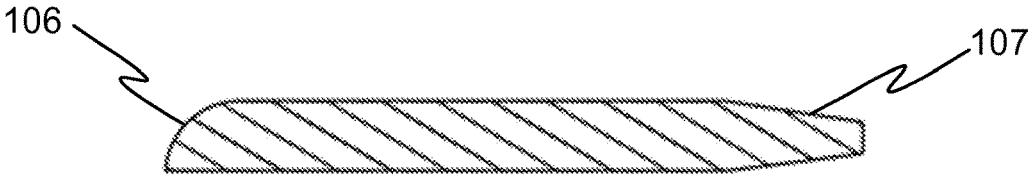
Figure 7E:
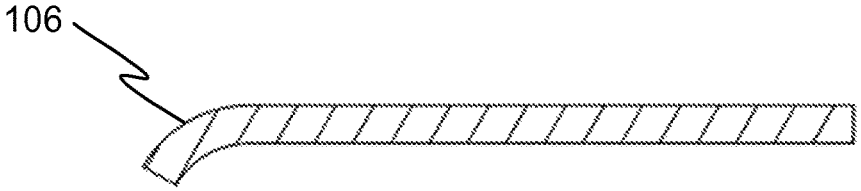

FIGS. 7A-7E illustrate exemplary profiles of the first and second radially extending bars. In FIG. 7A there is shown a cross-section of a radially extending bar, which has a leading edge 106 that is chamfered at one side. In FIG. 7B there is shown a cross-section of a radially extending bar, which has a leading edge 106 that is chamfered at one side and a trailing edge 107 that is chamfered at both sides. In FIG. 7C there is shown a cross-section of a radially extending bar in which both the leading edge 106 and the trailing edge 107 are rounded. In FIG. 7D there is shown a cross-section of a radially extending bar in which the leading edge 106 is rounded and the trailing edge 107 is chamfered at both sides. In FIG. 7E there is shown a cross-section of a radially extending bar in which the leading edge 106 is bent in the transverse direction of the radially extending bar.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to restrict the scope of protection of the invention as such.

The invention claimed is:

1. A grid for a tunnel thruster, the grid comprising:

a plurality of first radially extending bars arranged at angular intervals from each other, and a plurality of first connecting bars, each of the first connecting bars being connected between adjacent first radially extending bars, wherein the first radially extending bars are flat bars, each of the flat bars having a leading edge and a trailing edge that is rounded or chamfered.

2. The grid according to claim 1 wherein the first radially extending bars are flat bars, each of the flat bars being bent in a transverse direction of the flat bar.

3. The grid according to claim 1, wherein each of the first radially extending bars is connected to adjacent first radially extending bars with one of the first connecting bars.

4. The grid according to claim 1, wherein the first connecting bars are connected so that the first connecting bars are at a same distance from a center of the grid.

5. The grid according to claim 1, wherein first ends of the first radially extending bars are connected together.

6. The grid according claim 1, wherein the grid comprises a center part to which first ends of the first radially extending bars are connected.

7. The grid according to claim 1, further comprising a plurality of second connecting bars, each of the second connecting bars being connected between adjacent first radially extending bars-so that the second connecting bars are farther away from a center of the grid than the first connecting bars.

8. The grid according to claim 7, wherein the second connecting bars are connected so that the second connecting bars are at a same distance from the center of the grid.

9. The grid according to claim 7, wherein the grid comprises a plurality of second radially extending bars arranged at angular intervals from each other, each of the second radially extending bars being connected between one first connecting bar and one second connecting bar.

10. The grid according to claim 9, wherein the second radially extending bars are flat bars, each of the flat bars having a rounded or chamfered leading edge.

11. The grid according to claim 9, wherein the second radially extending bars are flat bars, each of the flat bars being bent in a transverse direction of the flat bar.

12. The grid according to claim 1, wherein the first and/or second radially extending bars and the first and/or second connecting bars are flat bars.

13. The grid according to claim 1, comprising 3-11 of the first radially extending bars and/or the second radially extending bars.

14. A tunnel thruster, comprising:

a tunnel section, and a propeller arranged inside the tunnel section, wherein the tunnel thruster comprises a grid according to claim 1 arranged in connection with an end of the tunnel section.

15. The tunnel thruster according to claim 14, wherein the grid is arranged inside the tunnel section at a distance of at least 10 mm from the end of the tunnel section.

16. The tunnel thruster according to claim 14, wherein the first radially extending bars are connected to the tunnel section.

17. The tunnel thruster according to claim 14, wherein a quantity of the first radially extending bars and/or the second radially extending bars differs from a quantity of propeller blades.

18. A vessel, wherein the vessel comprises a tunnel thruster according to claim 14 installed in a hull of the vessel.

* * * * *